US009850563B2

(12) United States Patent
D'Souza et al.

(10) Patent No.: US 9,850,563 B2
(45) Date of Patent: Dec. 26, 2017

(54) NI SUPERALLOY COMPONENT PRODUCTION METHOD

(71) Applicant: ROLLS-ROYCE PLC, London (GB)

(72) Inventors: Neil John D'Souza, Derby (GB); Kevin Goodwin, Derby (GB); Martin Richard Perry, Derby (GB)

(73) Assignee: ROLLS-ROYCE plc, London (GB)

( * ) Notice: Subject to any disclaimer, the term of this patent is extended or adjusted under 35 U.S.C. 154(b) by 372 days.

(21) Appl. No.: 14/614,732

(22) Filed: Feb. 5, 2015

(65) Prior Publication Data

US 2015/0225828 A1 Aug. 13, 2015

(30) Foreign Application Priority Data

Feb. 11, 2014 (GB) ..... 1402310.5

(51) Int. Cl.
*C22F 1/10* (2006.01)
*C22C 19/03* (2006.01)
(Continued)

(52) U.S. Cl.
CPC ..... *C22F 1/10* (2013.01); *C22C 19/057* (2013.01); *C22F 1/002* (2013.01); *C22F 1/008* (2013.01);
(Continued)

(58) Field of Classification Search
CPC ..... C22C 19/03–19/058; C22F 1/10; C23C 8/10; C23C 8/12
See application file for complete search history.

(56) References Cited

U.S. PATENT DOCUMENTS 4,810,312 A 3/1989 Allen
2004/0216813 A1 11/2004 Buergel et al.
(Continued)

FOREIGN PATENT DOCUMENTS

EP 1 512 482 A1 3/2005
JP H03-36255 A 2/1991
(Continued)

OTHER PUBLICATIONS

Jul. 9, 2015 partial Search Report issued in European Patent Application No. 15153931.9.
(Continued)

*Primary Examiner* — Lois Zheng
(74) *Attorney, Agent, or Firm* — Oliff PLC

(57) ABSTRACT

Producing a Ni superalloy component in which the superalloy has a γ phase matrix containing intermetallic γ' precipitates. Providing a Ni superalloy casting of the component; solutioning the component by heat treating the casting under vacuum and/or in an inert atmosphere at a temperature above the γ' solvus to homogenize the γ phase; quenching and ageing the solutioned component to grow intermetallic γ' precipitates in the homogenized γ phase. Before the solutioning step: heat treating the casting to produce a thermally grown oxide on the surface, oxide adherent to supress volatilization of Ni from the surface of the casting during the solutioning heat treatment. Performing the solutioning step under a Ni vapor pressure which is sufficient to supress volatilization of Ni from the surface of the casting during the solutioning heat treatment. During the solutioning heat treatment the component is encapsulated in a container protecting the casting from Si-doped contaminants.

14 Claims, 5 Drawing Sheets

(51) Int. Cl.

| | |
|---|---|
| ***C23C 8/10*** | (2006.01) |
| ***C23C 8/80*** | (2006.01) |
| ***C22F 1/00*** | (2006.01) |
| ***C22F 1/02*** | (2006.01) |
| ***C22C 19/05*** | (2006.01) |
| *C22C 19/00* | (2006.01) |

(52) U.S. Cl.
CPC ..... *C22F 1/02* (2013.01); *C23C 8/10* (2013.01); *C23C 8/80* (2013.01)

(56) References Cited

U.S. PATENT DOCUMENTS

2005/0051527 A1 3/2005 Kelly et al.
2012/0312426 A1* 12/2012 Suzuki ..... C22C 19/056 148/284

FOREIGN PATENT DOCUMENTS

JP H11-29822 A 2/1999
JP 2000-053492 A 2/2000

OTHER PUBLICATIONS

R. C. Reed, "The Superalloys Fundamentals and Applications," Cambridge University Presss, 2006, pp. 1-390.
J-O Anderson et al., "Thermo-Calc & Dictra, Computational Tools for Materials Science," CALPHAD, 2002, vol. 26, No. 2, pp. 273-312.
R. Darolia et al., "Formation of Topologically Closed Packed Phases in Nickel Base Single Crystal Superalloys," The Metallurgical Society, 1988, pp. 255-264.
Z. Suo et al., "Stresses induced in alloys by selective oxidation," Acta Materialia, 2003, vol. 51, pp. 959-974.
C.B. Alcock et al., "Vapour Pressure Equations for the Metallic Elements: 298-2500K," Department of Metallurgy and Materials Science, University of Toronto, 1984, vol. 23, pp. 309-313.
G. Brewster et al., "Mechanism for Formation of Surface Scale during Directional Solidification of Ni-Base Superalloys," Metallurgical and Material Transactions, 2010, vol. 41A, No. 6, pp. 1288-1302.
C.D. Wagner, "Handbook of x-ray photoelectron spectroscopy." Perkin-Elmer Corp, 1979.
Francesco Consentino, "Numerical Modeling of Vacuum Heat Treatment of Nickel-based Superalloys," The Minerals, Metals & Materials Society and ASM International, 2013, vol. 44A, pp. 5154-5164.
N. D'Souza et al., "Role of Elemental Sublimation during Solution Heat Treatment of Ni-Based Superalloys," The Minerals, Metals & Materials Society and ASM International, 2013, vol. 44A. pp. 4764-4773.
G.E. Fuchs, "Solution heat treatment response of a third generation single crystal Ni-base superalloy," Materials Science and Engineering, 2001, vol. 300, pp. 52-60.
A. Heckl et al., "Reasons for the enhanced phase stability of Ru-containing nickel-based superalloys," Acta Materialia, 2011, vol. 59, pp. 6563-6573.
Leonard D. Jaffe et al., "Evaporation Effects on Materials in Space," Jet Propulsion Laboratory California Institute of Technology, 1961, No. 12744, pp. 1-18.
I. Langmuir et al.,"The Vapor Pressure of Metallic Tungsten," Physikalische Zeitschrift, 1913, vol. 14, pp. 1273-1280.
N. D'Souza et al., "Role of Elemental Sublimation during Solution Heat Treatment of Ni-Based Superalloys," Metallurgical and Materials Transactions, 2013, vol. 44A, No. 10, pp. 4764-4773.
T.J. Nijdam et al., "Modelling of composition and phase changes in multiphase alloys due to growth of an oxide layer," Acta Materialia, 2008, vol. 56, pp. 4972-4983.
Jul. 30, 2014 Search Report issued in British Application No. GB1402310.5.
F. D. Richardson et al., "The Thermodynamics of Substance of Interest in Iron and Steel Making from 0° C. to 2400° C.," Journal of the Iron and Steel Institute, 1948, vol. 160, part 3, pp. 260-271.

* cited by examiner

NI SUPERALLOY COMPONENT PRODUCTION METHOD

FIELD OF THE INVENTION

The present invention relates to a method of producing a Ni superalloy component in which the superalloy has a γ phase matrix containing intermetallic γ' precipitates.

BACKGROUND OF THE INVENTION

Superalloys are a class of materials that have been specifically developed for high-temperature applications, such as gas turbine blades. The evolution from the 1st to 4th generation Ni-based superalloys has been motivated by the stringent demands on improved creep and fatigue resistance at elevated temperatures that is achieved by (1) increased solid solution strengthening and (2) the increased volume fraction of the precipitated γ' phases in the solid state. In order to achieve these goals, the alloys contain increasing amounts of refractory alloying elements such as Mo, Re, Ta, and W. The as-cast microstructure in the latest generation alloys is therefore associated with increasing levels of microsegregation and is consequently required to be heat treated to dissolve the low-melting interdendritic phases and to homogenize the microstructure.

During solutioning the alloy is heated above the γ' solvus in the γ phase-field over a period of usually about 8 hours to homogenize the γ phase. However, it has been observed that during solutioning a microstructural instability develops, particularly across regions that are scaled with NiO surface oxide, the instability being a result of incipient melting and/or a discontinuous precipitation reaction that results in a γ' matrix with topologically close-packed (TCP) precipitates and γ-lamellae and the existence of a polycrystalline microstructure. At first sight that is unexpected, given that solutioning occurs within the γ phase-field. A cause of the instability seems to be Ni, Al, Co and Cr loss via evaporation, which destabilizes the γ phase and is followed by redistribution of refractory alloying elements.

The role of evaporation and oxidation on microstructural instability during solution heat treatment of Ni-based superalloys is described in D'Souza et al, Met. Trans. A, Vol. 44A, 2013, pp. 4764-4773.

When the surface microstructural instability occurs, extensive reworking of the component can be required. Where a turbine blade aerofoil surface is involved, such reworking can be detrimental to the shape of the aerofoil and can lead to blade non-conformance. By lowering the solutioning temperature, the surface microstructural instability can be suppressed, but this leads to under-solutioning of the bulk.

Other solutioning techniques are described in, for example, US 200510051527, JR 11-29822 and US 2004/0216813.

SUMMARY OF THE INVENTION

It would be desirable to be able to reduce or eliminate the occurrence of the surface microstructural instability during solutioning of a Ni superalloy casting.

Accordingly, in a first aspect, the present invention provides a method of producing a Ni superalloy component in which the superalloy has a γ phase matrix containing intermetallic γ' precipitates, the method including steps of:

providing a Ni superalloy casting of the component, solutioning the component by heat treating the casting under vacuum and/or in an atmosphere wherein the partial pressure of $O_2$ during the oxidising heat treatment is less than 0.21 atm at a temperature above the γ' solvus to homogenise the γ phase, and quenching and then ageing the solutioned component to grow intermetallic γ' precipitates in the homogenised γ phase;

wherein the method further includes, before the solutioning step, a step of:

heat treating the casting to produce a thermally grown oxide on the surface thereof, the oxide being sufficiently adherent and stable to substantially supress volatilisation of Ni and Cr from the surface of the casting during the solutioning heat treatment.

The thermally grown oxide (TGO), being adherent and stable, forms a barrier to the volatilisation of Ni and Cr, and thereby suppresses development of the surface microstructural instability.

Optional features of the first aspect of the invention will now be set out. These are applicable singly or in any combination with the method.

The TGO may be $Al_2O_3$. $Al_2O_3$ TGO is much more adherent and stable than the NiO surface oxide scale, which typically either dissociates or vaporises during solutioning. Indeed, $Al_2O_3$ TGO is generally also more adherent than any $Al_2O_3$ reaction layer formed on the surface of the casting as a result of the casting process. Thus the TGO can provide protection against the surface microstructural instability even in regions that do not have NiO surface oxide scale.

The oxidising heat treatment may be performed at a temperature above around 800° C.

The oxidising heat treatment is performed at a temperature below around 1100° C.

In a further embodiment, the oxidising heat treatment may be performed between around 800° C. and around 1000° C.

In a yet further embodiment, the oxidising heat treatment may be performed at a temperature between around 800° C. and around 900° C.

The oxidising heat treatment may be conducted in a furnace environment comprising air, or at any such partial pressure of $O_2$ between that of around 0.21 atm (212.78 mbar) and around $1\times10^{-14}$ atm ($1\times10^{-11}$ mbar).

Optionally, the oxidising heat treatment may be conducted in a furnace environment comprising air, or at any such partial pressure of $O_2$ between that of around 0.21 atm (212.78 mbar) and around $1\times10^{-11}$ atm ($1\times10^{-8}$ mbar).

Optionally, the oxidising heat treatment may be conducted in a furnace environment comprising air, or at any such partial pressure of $O_2$ between that of around 0.21 atm (212.78 mbar) and around $1\times10^{-9}$ atm ($1\times10^{-6}$ mbar), The partial pressure of $O_2$ during the oxidising heat treatment may be less than 1×10−9 atm ($1\times10^{-6}$ mbar), or may optionally be less than $1\times10^{-11}$ atm ($1\times10^{-8}$ mbar) or $1\times10^{-14}$ atm ($1\times10^{-11}$ mbar). By reducing the partial pressure of $O_2$ to such an extent, the formation of NiO TGO can be suppressed, without inhibiting the formation of $Al_2O_3$ TGO. The oxidising heat treatment may be performed for up to around 1 hour, and preferably for at least 2 or 4 hours. In general, the heat treatment time is inversely proportional to the heat treatment temperature.

Following the oxidising heat treatment, the oxide developed may have a thickness of between 0.1 μm.

Optionally, the oxide layer developed following the oxidising heat treatment may have a thickness of between 1 μm and 40 μm Optionally, the oxide layer developed following the oxidising heat treatment may have a thickness of between 1 μm and 10 μm.

Optionally, the oxide layer developed following the oxidising heat treatment may have a thickness of between 2 μm and 5 μm. Optionally, the process further comprises the removal of the TGO from the Ni superalloy component following any one or more of the oxidising heat treatment stages.

The thermally grown oxide may be removed from the Ni superalloy component following the oxidising heat treatment.

In particular, following the oxidising heat treatment, the thermally grown oxide may be removed following any one or more of the solutioning, quenching or aging stages. It will be appreciated that the developed oxide may be removed at any or more of the stages during the manufacturing process. Additionally, it will be appreciated that the TGO layer may be removed in its entirety, or in part. Thus, a section of the TGO may be removed such that further operations may be conducted on the exposed base metal, allowing the TGO layer to remain until a later stage in the manufacturing process, where it is subsequently removed.

Further features may be formed or machined into the Ni superalloy component following the removal of the thermally grown oxide.

Thus, the process further comprises the forming or machining of features into or within the Ni superalloy component following any one or more of the oxidising heat treatment or oxide removal stages. The additional process of forming or machining features into the superalloy component is most regularly conducted following any one or more of the solutioning, quenching or aging stages. It will however be appreciated that the additional process of forming or machining holes or further features within the superalloy component may be conducted at any required stage during the manufacturing process.

As well as forming the TGO, the solutioning step may be performed under a Ni vapour pressure which is sufficient to substantially suppress volatilisation of Ni from the surface of the casting during the solutioning heat treatment. Indeed, performing the solutioning step under a Ni vapour may make it unnecessary to form a TGO.

Thus, in a second aspect, the present invention provides a method of producing a Ni superalloy component in which the superalloy has a γ phase matrix containing intermetallic γ' precipitates, the method including steps of:

providing a Ni superalloy casting of the component, solutioning the component by heat treating the casting under vacuum and/or in an atmosphere wherein the partial pressure of $O_2$ during the oxidising heat treatment is less than 0.21 atm at a temperature above the γ' solvus to homogenise the γ phase, and quenching and then ageing the solutioned component to grow intermetallic γ' precipitates in the homogenised γ phase;

wherein the solutioning step is performed under a Ni vapour pressure which is sufficient to substantially supress volatilisation of Ni from the surface of the casting during the solutioning heat treatment.

Optional features of the second aspect of the invention, or the first aspect of the invention when the solutioning step is performed under a Ni vapour pressure, will now be set out. These are applicable singly or in any combination with the method.

During the solutioning step, the casting may be heat treated at a temperature above the γ' solvus in the presence of sacrificial Ni to produce the Ni vapour pressure. For example, the sacrificial Ni may be in form of Ni foil. The area ratio of the sacrificial Ni to the area of the component may be at least 1:1.

The present invention is also at least partly based on recognition that, while the role of Ni and Cr vaporisation is important, the re-condensation of an Al-rich β phase doped with Si and subsequent interdiffusion at the casting surface can govern the extent to which the microstructural instability penetrates into the casting. The source of the Si can be the silicone liquid which is the typical working fluid of diffusion pumps. Thus during the solutioning heat treatment, the component is encapsulated in a container which protects the casting from Si-doped contaminants. In this way, the surface microstructural instability can be suppressed or avoided. Indeed, encapsulating the component may make it unnecessary to form a TGO and/or perform the solutioning step under a Ni vapour.

Thus, in a third aspect, the present invention provides a method of producing a Ni superalloy component in which the superalloy has a γ phase matrix containing intermetallic γ' precipitates, the method including steps of:

providing a Ni superalloy casting of the component, solutioning the component by heat treating the casting under vacuum and/or in an atmosphere wherein the partial pressure of $O_2$ during the oxidising heat treatment is less than 0.21 atm at a temperature above the γ' solvus to homogenise the γ phase, and quenching and then ageing the solutioned component to grow intermetallic γ' precipitates in the homogenised γ phase;

wherein during the solutioning heat treatment, the component is encapsulated in a container which protects the casting from Si-doped contaminants.

Optional features of the third aspect of the invention, or the first or second aspect of the invention when the component is encapsulated in a container, will now be set out. These are applicable singly or in any combination with the method.

Conveniently, the container may be formed of alumina, which does not react with the superalloy at the solutioning heat treatment temperature.

The container wall thickness may be at most 5 mm. Limiting the wall thickness in this way allows encapsulated component to be quenched (e.g. by gas fan quenching) in the quenching and ageing step at high rates. Quench rates of about 400 $Kmin^{-1}$ can be achieved.

Optional features of any of the above aspects of the invention will now be set out. These are applicable singly or in any combination with the method.

The method may include a step of mechanically abrading the surface of the component (e.g. by grit blasting) to remove any surface microstructural instability that forms as a result of the solutioning heat treatment.

The component may be a turbine blade.

The Ni superalloy casting may be a single crystal casting.

Accordingly, in a fourth aspect, the present invention provides a method of producing a Ni superalloy component in which the superalloy has a γ phase matrix containing intermetallic γ' precipitates, the method including steps of:

providing a Ni superalloy casting of the component, solutioning the component by heat treating the casting under vacuum and/or in an atmosphere wherein the partial pressure of $O_2$ during the oxidising heat treatment is less than 0.21 atm at a temperature above the γ' solvus to homogenise the γ phase, and quenching and then ageing the solutioned component to grow intermetallic γ' precipitates in the homogenised γ phase;

wherein the method further includes, before the solutioning step, a step of:

heat treating the casting to produce a thermally grown oxide on the surface thereof, the oxide being sufficiently adherent and stable to substantially supress melting of Ni and Cr from the surface of the casting during the solutioning heat treatment.

Accordingly, in a fifth aspect, the present invention provides a method of producing a Ni superalloy component in which the superalloy has a γ phase matrix containing intermetallic γ' precipitates, the method including steps of:

providing a Ni superalloy casting of the component, solutioning the component by heat treating the casting under vacuum and/or in an inert atmosphere at a temperature above the γ' solvus to homogenise the γ phase, and quenching and then ageing the solutioned component to grow intermetallic γ' precipitates in the homogenised γ phase;

wherein the method further includes, before the solutioning step, a step of:

heat treating the casting to produce a thermally grown oxide on the surface thereof, the oxide being sufficiently adherent and stable to substantially supress volatilisation of Ni from the surface of the casting during the solutioning heat treatment.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
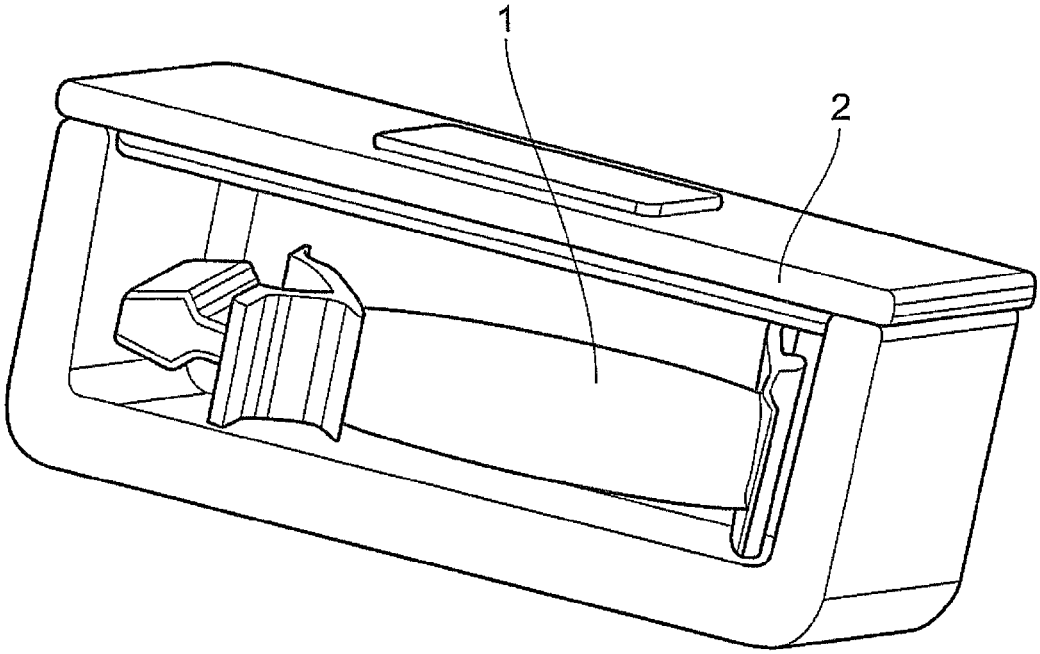
FIG. 1 shows a turbine blade located in an encapsulating box.

The cause of incipient surface melting and/or discontinuous precipitation at the surface of Ni superalloy turbine blades 1 or test bars following solutioning (typically at temperatures of 1300° C.-1360° C., total pressure (Ar atmosphere) of 0.5 mbar, and for isothermal holds times ranging from 7 hrs-25 hrs) has been shown to be related to vaporisation of Ni, Al, Co and Cr from the surface, followed by solute diffusion within the surface layers (D'Souza et al. ibid.).

One approach of the present invention to alleviate the effects of surface melting and/or discontinuous precipitation is to reduce the role of elemental vaporisation from the surface of the component during solutioning. To control vaporisation, two methods can be adopted:

(1) Since vaporisation occurs from a "native" surface, a first method is to "passivate" the surface of the component by pre-oxidation before solutioning heat treatment. The oxide that forms on the surface then provides a "physical barrier" to vaporisation.

(2) A second method makes use of the fact that the Ni vapour pressure is fixed at a given temperature and therefore an alternate source of Ni can be provided. This alternate source can conveniently be in the form of a "sacrificial" Ni foil that loses Ni via vaporisation more effectively than the component, and thereby suppresses the loss of Ni from the component.

However, another approach of the present invention is to reduce the role of condensation:

(3) Accordingly, a third method accepts that vaporisation may occur, but by reducing or eliminating the re-condensation of Si-doped contaminants on the component during the solutioning heat treatment, the extent of microstructural instability (i.e. the extent of ingress of the surface layer into the substrate) can be decreased.

The methods are not mutually exclusive, and thus any one, any two, or all three of the methods can be adopted.

Ideally, the present invention would completely avoid the microstructural instability. However, even if this is not possible and a surface microstructure does develop, as long as the present invention restricts its ingress into the component to a surface layer of less than about 50 μm thickness, then post-processing operations such as grit blasting of the surface can be used to substantially entirely eliminate the surface layer. Such post-processing operations are in any event typically performed to remove P-pins (used for pinning the wax investment casting core to the ceramic shell of the mould) and other casting related features such as grain continuators, feeder pads etc.

We now describe each of the above methods in more detail.

(1) Pre-Oxidation:

The as-cast surface of turbine blade aerofoils may be characterised by a mixed TGO, which is known as scale, owing to its roughness/texture resembling "fish-scale". Scale has an outer NiO layer, an inner layer of Ta/Si oxides, and possibly some spinels, and generally has a spatial extent resembling a "tongue" on the convex surface of the blade 1. Remaining portions of the aerofoil may be covered with a non-thermally grown, $Al_2O_3$ reaction layer (termed as unscaled). Details of the mechanism for the formation of these surface layers are described in Brewster et al., Met. Trans. A, Vol. 43, 2012, pp. 1288-1302.

Accordingly, the oxidising heat treatment is most regularly performed at a temperature between 800° C. and 1100° C., the preferable range being between 800° C. and 900° C., and the most preferable temperature being approximately 850° C. It is well known that the rate at which the TGO layer develops varies with temperature, so increasing the temperature to the uppermost limit of the specified temperature range will necessarily reduce the required amount of time to develop a layer of targeted TGO layer thickness. Conversely, reducing the temperature to the lowermost limit of the specified temperature range will necessarily increase the required amount of time to develop a layer of targeted TGO layer thickness.

In particular, and in accordance with the above, scale is porous and not dense and, moreover, NiO is thermodynamically unstable during solutioning and can either dissociate or vaporise at typical solutioning temperatures. Further, the un-scaled reaction layer ($Al_2O_3$) has poor adherence with the substrate and typically spalls away during solutioning. Both these conditions therefore lead to an un-protected blade 1 during solutioning, and exacerbate elemental vaporisation of Ni, Al, Co, and Cr from the substrate.

However, pre-oxidation prior to solutioning allows a TGO to form on the surface of the blade 1 which is both adherent and thermodynamically stable, and consequently protects the blade 1 surface from vaporisation effects. The pre-oxidation conditions can be used to form (i) a mixed oxide, i.e. NiO, an inner Ta oxide, followed by internal oxidation to form $Al_2O_3$, or (ii) exclusively $Al_2O_3$. Either way, however, the protection against vaporisation is provided principally by a stable, adherent $Al_2O_3$ layer.

Whether (i) or (ii) proceeds can be controlled by the temperature and corresponding partial pressure of $O_2$ ($p_{O_2}$) (see F. D. Richardson and J. H. E. Jeffes, Journal of the Iron and Steel Institute, 1948, Vol. 160, pp. 261-270):

For Ni oxidation: $2Ni_{(S)}+O_2=2NiO_{(S)}$; $p_{O_2}>\exp[1000(-489.1/T+0.197)/8.314]$ atm For Al oxidation: $4/3Al_{(L)}+O_2=(2/3)Al_2O_{3(S)}$; $p_{O_2}>\exp[1000(-1117.31T+0.213)/8.314]$ atm where T=temperature (K). Typical pre-oxidation temperatures are between 800-1100° C. Thus to form NiO at 800° C. requires $p_{O_2}>3\times10^{-14}$ atm and to form NiO at 1100° C. requires $p_{O_2}>5\times10^{-9}$ atm. In contrast, to form $Al_2O_3$ at 800° C. requires $p_{O_2}>5\times10^{-44}$ atm and to form $Al_2O_3$ at 1100° C. requires $p_{O_2}>5\times10^{-32}$ atm.

$Al_2O_3$ will almost inevitably form during pre-oxidising given its high thermodynamic stability (large negative free energy of formation). However the formation of NiO can be suppressed by reducing $p_{O_2}$ to less than $1\times10^{-9}$ atm ($1\times10^{-6}$ mbar), and is preferably less than $1\times10^{-11}$ atm ($1\times10^{-8}$ mbar) or $1\times10^{-14}$ atm ($1\times10^{-11}$ mbar). This can be accomplished by pre-oxidising in an Ar atmosphere, for example by evacuating the air and then back-filling with Ar gas up to a fixed pressure. A hold time of at least one hour, and preferably up to at least two or four hours, generally provides an oxide layer which is sufficiently adherent and stable to avoid or substantially reduce loss of volatile elements, such as Ni, Al, Cr and Co, from the surface during subsequent solutioning.

Accordingly, the oxidising heat treatment is conducted either in a furnace environment comprising air, or at any such partial pressure of $O_2$ between that of or at any such partial pressure of $O_2$ between that of around 0.21 atm (212.78 mbar) and around $1\times10^{-14}$ atm ($1\times10^{-11}$ mbar). It will also be appreciated that the partial pressure of $O_2$ during the oxidising heat treatment may be less than $1\times10^{-9}$ atm ($1\times10^{-6}$ mbar), or may optionally be less than $1\times10^{-11}$ atm ($1\times10^{-8}$ mbar) or $1\times10^{-14}$ atm ($1\times10^{-11}$ mbar). By reducing the partial pressure of $O_2$ to such an extent in accordance with the temperatures and partial pressures of oxygen required to suppress the formation of NiO TGO, the formation of NiO TGO can be suppressed, without inhibiting the formation of $Al_2O_3$ TGO.

Following the oxidising heat treatment in accordance with the outlined temperature ranges, the TGO layer developed will most commonly comprise a thickness of between 0.1 μm and 40 μm, although will most preferably comprise a thickness of between 2 μm and 5 μm.

It will also be appreciated that the operating conditions and time required to provide the required thickness of oxide layer will vary depending on the above-mentioned factors. In particular, the time required to develop a particular TGO will vary depending on, for example, the thickness of TGO layer required, the hold temperature and the partial pressure of $O_2$ ($p_{O_2}$) used within the heat treatment environment (and hence the specific formation of $Al_2O_3$ and/or NiO).

(2) Ni Vapour Pressure:

Another method of suppressing vaporisation from the surface of the blade is to perform the solutioning under a Ni vapour pressure, produced e.g. by sacrificial Ni such as Ni foil. The large surface/volume ratio of such foil causes large amounts of Ni vaporisation from its surface. This in turn significantly suppresses loss of Ni from the turbine blade 1 surface. Since the mole fraction of Ni in the superalloy of the blade 1 is about 0.7, the vaporisation of other elements, such as Al, Cr and Co, from the blade 1 is of secondary importance. Further, it is reasonable to assume that the kinetics of Ni vaporisation from both surfaces (Ni foil and blade 1) are equivalent.

The extent of vaporisation of Ni from the blade 1 and foil surfaces is, to a first approximation, dependent on the ratio of the two areas. Since solutioning is generally carried out in a batch, this can restrict the amount of available free space for placement of the foil (e.g. interspersed between the blades) in the furnace. A ratio of at least 1:1 for the respective surface areas of the foil and the turbine blade 1 is preferred, but a drawback of such a ratio is that it can significantly reduce the number of turbine blades 1 that can be batch solutioned. Ratios of 1:2 to 1:10 (foil:blade) can thus be used in principle, but lower ratios are less effective at suppressing the amount of vaporisation.

(3) Encapsulation:

Re-condensation of Al-rich β phase and subsequent inter-diffusion with the substrate at the surface can govern the extent to which the microstructural instability at the surface extends into the substrate. The following Appendix describes a study on the effects of elemental vaporisation and condensation during heat treatment of single crystal superalloys. The study highlights the role of the Al-rich β phase. Additional work not referred in the Appendix showed that the Al-rich β phase is doped with Si, with the typical Si composition in the β phase being in the range from 1 to 1.4 wt. %. It is believed that the Si plays a significant role in facilitating the nucleation and/or the growth of the Al-rich β phase. Thus by reducing the availability of Si, Al-rich β phase re-condensation can be reduced or avoided.

A likely source of Si is in the back-streaming of the silicone liquid, which is the typical working fluid of diffusion pumps. Hence, another method in suppressing microstructural instability is to present a "barrier" to the liquid droplets of β phase that condense on the surface of the test piece. The instability at the surface is then only driven by vaporisation, and the resultant layer can be much thinner.

FIG. 1 shows a turbine blade 1 located in an encapsulating box 2. Encapsulation of the blade 1 is completed by a lid (not shown). The box 2 can be made from 99% alumina. The box dimensions can be determined by the dimensions of the blade 1 contained therein. For example, it is convenient to have a box 2 that encapsulates a single blade 1. The box thickness can be at most 5 mm in order to achieve a suitable quench rate (e.g. 400 K $min^{-1}$) following solutioning and before ageing, the aim being to prevent any solute diffusion within the solid and to obtain a very fine γ' precipitate size that nucleates during rapid cooling within the γ phase matrix. The seal between the lid and box 2 may not be perfect (the box 2 does not need to be evacuated) and there may be limited vapour released from the blade 1 surface which escapes through this seal. However, the rate of vaporisation can be reduced relative to an unencapsulated blade 1. However most importantly, subsequent ingress of the doped β phase onto the blade 1 surface is substantially reduced owing to the encapsulation.

Following the methods described in accordance with the present invention to control and/or suppress vaporisation, it is also required that any one or more of subsequent pickling, abrasive, physical, chemical, laser or electro-chemical machining stages, or any such further means of material removal known within the art, be used to remove the developed TGO. In particular, the developed TGO may include one or more of (i) a mixed oxide, i.e. NiO, an inner Ta oxide, followed by internal oxidation to form $Al_2O_3$, or (ii) exclusively $Al_2O_3$.

In particular, the removal of the developed TGO is most regularly conducted following the solutioning, quenching and aging stages wherein subsequent oxide layers may form, although it will be appreciated that the developed oxide may be removed at any required stage during the manufacturing process.

Additionally, it is often required that material be removed and/or further features, shapes, holes, channels or recesses formed or machined into the Ni superalloy component. In particular, material removal and/or machining processes are most regularly conducted towards the final stages of the manufacturing process following any one or more of the solutioning, quenching, aging or oxide removal stages.

Accordingly, a method for creating the thermally grown oxide layer described above comprises the steps of:

1. Providing a Ni superalloy casting of the component.
2. Heat treating the casting to produce a thermally grown oxide on the surface thereof.
3. Solutioning the component by heat treating the casting.
4. Quenching and then optionally ageing the solutioned component to grow intermetallic γ' precipitates in the homogenised γ phase.
5. Optionally removing the thermally grown oxide from the Ni superalloy component
6. Optionally machining or forming further features into the Ni superalloy component following the removal of the thermally grown oxide.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to herein are hereby incorporated by reference.

APPENDIX

Introduction

The single crystal superalloys used for hot section components in aero-engines and land-based turbines for power generation must be heat treated prior to service entry. The use of directional solidification techniques demands this, because the dendritic microsegregation so produced [1] would otherwise exacerbate incipient melting during operation. Heat treatment is carried out under vacuum or a reduced pressure of Ar, since the temperatures needed are high—perhaps around 1300° C.—so that surface oxidation would otherwise occur. For any given alloy composition, a heat-treatment window is required: long-range diffusion leads to dissolution of the γ' strengthening phase and homogenisation of the segregated dendritic as-cast microstructure [2]. Gas fan quenching is used to develop an optimised γ' precipitate size and morphology. Until now, all rationalisation of microstructural evolution and modelling of the heat treatment process have assumed that neither mass nor heat is exchanged with the environment; thus as a thermodynamic system it is assumed to be closed.

In this paper, this basic and long-standing assumption is shown to be incorrect. Some critical elements—notably Ni and Al—are lost from the surface by vaporisation and there is subsequent condensation of the Al-enriched vapour. Thus, the occurrence of unusual surface microstructural features which resemble discontinuous precipitation (γ'+TCP phases)—thus far unexplained—is rationalised [3]. The implications of this study are significant—the extent to which this surface layer ingresses into the substrate during solutioning has further downstream effects following coating, resulting in a deficit in the load bearing capacity during service.

Experiments

The third generation Ni-base superalloy CMSX-10N® [trademark of Cannon-Muskegon Corporation] of nominal composition (wt. %); Ni-5.85Al-3.1Co-1.7Cr-0.45Mo-6.8Re-8.5Ta-0.08Ti-5.5W was employed. Cylindrical bars of length 70 mm and diameter 10 mm were used in the as-cast condition; these were grit-blasted with $Al_2O_3$ media to remove all surface oxides and a thin layer of substrate material (up to ~50 μm). All solutioning experiments were conducted in a vacuum furnace with flowing Ar atmosphere of partial pressure of $10^{-4}$ mbar [4]. The heating protocol involved a series of ramps and isothermal holds for temperature equilibration until the set temperature of 1360° C. was attained and the time to reach temperature was 4 hrs, while a soak of 1 hr at top temperature was used; i.e. partial solutioning. Quenching was done in an argon flow at approximately 90 K $min^{-1}$. In the first experiment, bars were solutioned on their own and located in an alumina boat and served as reference samples, while in the second experiment, the samples were placed in an alumina boat, with dispersed sheets of Ni foils spread within the furnace. Specimens were sectioned from bars and prepared using standard metallographic techniques. Scanning electron microscopy (SEM) was done using FEI Nova 600 Nanolab and images were captured in back scattered electron (BEI) mode, Composition measurements were done using energy dispersive spectroscopy (EDS) with spectra collected at 20 kV using a nominal current of 2.3 nA, a working distance of 5 mm, an amplification time of 1.6 μs and a live time of 30 s. Electron backscatter diffraction (EBSD) maps were collected using orientation imaging microscopy (OIM™) data collection software at 300 frames per second and patterns were indexed against fcc and bcc structure files. All maps were collected at 20 kV and using a high current of approximately 24 nA, Condensed vapour during solutioning was captured using an $Al_2O_3$ tile, i.e. a cold trap located in the direct line-of-sight of the sample surface. The composition was analysed using Thermo Fisher Scientific K-Alpha X-ray photoelectron spectroscopy (XPS), equipped with a charge coupled flood gun and a monochromatic Al X-ray source (1486.7 eV) radiation, a slit width of 0.8 mm and a take-off angle of 90°. The spot size in the analysis was 400 μm. The deposited layer on the alumina boat was also analysed using transmission electron microscopy (TEM). The sample was prepared using the state-of-the-art in-situ lift-out technique and thinned using the focused ion beam (FIB) to electron transparency. The prepared sample was analysed in a JEOL 2000 FX TEM equipped with an ultra-thin window Oxford SiLi EDS detector. Multiple areas were analysed simply by focussing the beam to a spot and acquiring a spectra for 30 s (live time).

Discussion

Figure 2:
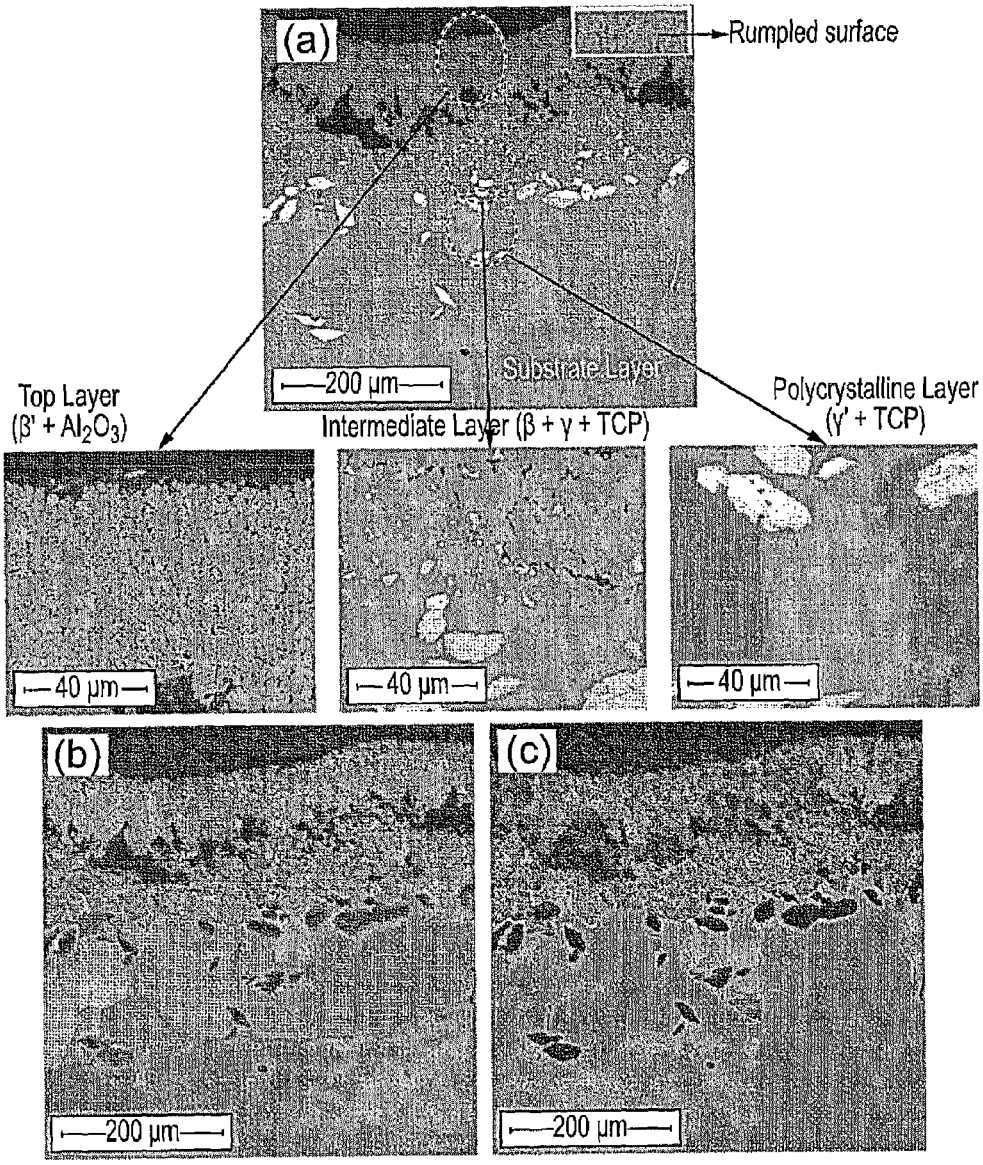
FIG. 2 shows BEI and EBSD images of cross-sections of rumpled surface (inset) of sample exposed to a furnace environment: (a) BEI image; (b) EBSD orientation map; (c) EBSD phase distribution map. In the top layer there are $\beta+Al_2O_3$ phases; in the intermediate layer there are [β+γ'+TCP] phases; in the large-grain layer there are γ'+TCP phases. Note that γ and γ' phases cannot be recognised independently in the EBSD phase distribution map (c).

The macrostructure corresponding to test bars in the open boat is shown in FIG. 2(*a*)—its surface has a rumpled morphology. Four distinct layers are found as one transverses from the surface to the matrix: top layer, intermediate layer, polycrystalline layer growing into the substrate, and substrate. The top layer of thickness ~100 μm is polycrystalline [inverse pole figure (IPF) in FIG. 2(*b*)], and corresponds to the β phase, as proven by the $$\left[\frac{\mathrm{Ni}}{\mathrm{Al}}\right] = \left[\frac{58}{36}\right] \text{ atomic ratio from } EDS \text{ analysis}$$

and the OIM derived phase map in FIG. 2(*c*). Dispersed $Al_2O_3$ stringers having the black interwoven morphology also exist within the β grains. The morphology indicates that the β phase condenses from the vapour phase in the form of crystals of random orientation; subsequent oxidation of these polycrystalline β grains occurs to form $Al_2O_3$. The intermediate layer is approximately 80 μm thick and consists of three phases: (a) the bright particles are refractory-rich (W and Re) TCP phases, (b) the grey lamellar structure is γ' phase $$\left(\left[\frac{\mathrm{Ni}}{\mathrm{Al}}\right] = \left[\frac{67}{15}\right] \text{ atomic ratio from } EDS \text{ analysis}\right),$$

and (c) the dark matrix is β. The polycrystalline layer growing into the substrate is up to 200 μm thick, and consists of γ' phase and refractory-rich (W and Re) TCP phases. Owing to the low voltage accelerating condition (5 kV), the polycrystalline morphology growing into the substrate is also imaged using BEI owing to the channelling contrast. The substrate comprises of γ phase (γ'precipitates in solid-state) and the non-equilibrium (γ+γ') inter-dendritic region.

Figure 3:
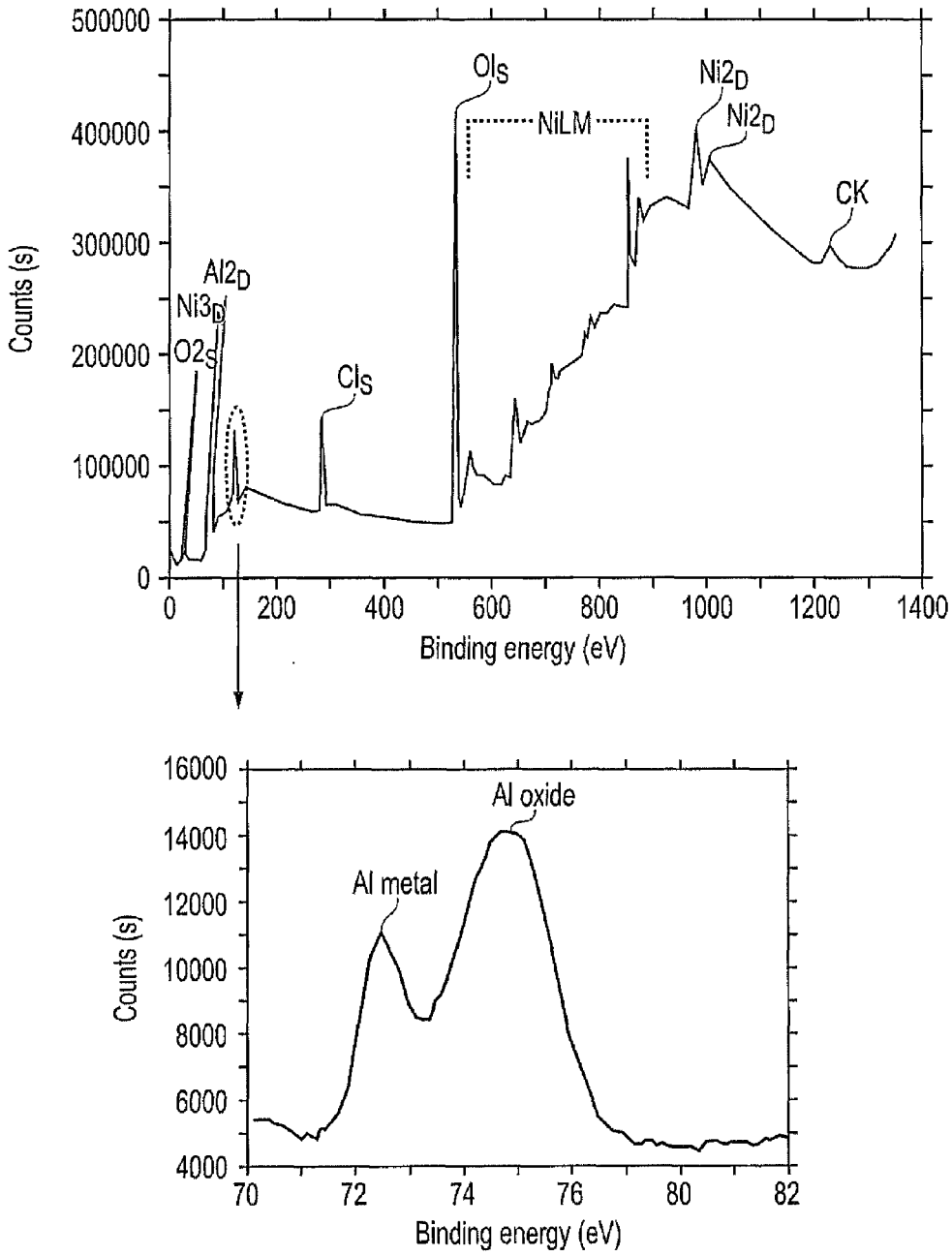
FIG. 3 shows XPS results of the condensate on an alumina tile, showing peaks for Ni, Al and $Al_2O_3$.

FIG. 2 confirms that elemental vaporisation is occurring from the sample surface. Consistent with this, a clear discolouration was observed on the tile surface (cold trap). XPS line scans across the surface deposit revealed indexed peaks for the corresponding species based on their binding energies (FIG. 3) [5]. The principal species were Ni, Al and $Al_2O_3$ and to a minor extent Co and Cr (the latter were detected using EDS on TEM samples taken from the condensate). It is emphasised that NiO is absent and the presence of $Al_2O_3$ arises from sampling of the substrate ($Al_2O_3$ tile), since the condensate is granular in nature and sampling of the substrate arises between abutting grains. Therefore, the XPS trace in FIG. 3 unequivocally points to the loss of Ni and Al loss from the surface of the bar by vaporisation. This is consistent with the high vaporisation rates of Ni, Co and Cr which are several orders of magnitude greater than for the other elements [6]. No data exists in the literature for Al, since elemental Al is liquid at these temperatures, albeit it is solid when alloyed; all other elements being solid at the solutioning temperature. The elemental loss during vaporisation is accompanied by subsequent solute re-distribution within the substrate. However, vaporisation kinetics are not straightforward unless in the presence of vacuum, where Langmuir's equation can be used [7]. The presence of oxide, Ar carrier gas and alloying have a profound effect on the elemental vapour loss. Therefore unlike the case of oxidation where oxidation kinetics can be coupled with solute diffusion to determine the evolution of phases [8]—modelling of all these effects accounting for vaporisation and subsequent condensation is difficult, not least because experimental data are lacking.

A simplified first order approach involves a consideration of the processes of vaporisation, condensation and resultant diffusion in the substrate. From a mass balance that considers the different morphologies and thicknesses of (i) the vaporisation layer [top and intermediate layers in FIG. 2(*a*)], and (ii) the affected substrate [polycrystalline layer in FIG. 2(*a*)], the evolution of phases within the surface-affected zone can be determined. The extent of metal loss from vaporisation can be estimated from the thickness of the top and intermediate layer: ~[70+50]μm=120 μm. The elements Ni, Al, Co and Cr vaporise from this layer, with the predominant Ni loss being consistent with the rumpled surface of FIG. 2(*a*). The thickness of the affected substrate at the surface is ~150 μm and since diffusion is neglected in this calculation, it is assumed that the remaining elements (Mo, Ti, Ta, W and Re) are incorporated within the substrate of this thickness (at composition $C_1$) following vaporisation of a layer of solid at the surface. This corresponds to a ratio of $$\text{vaporised layer/substrate} = \frac{t_{Top} + t_{Intermediate}}{t_{Substrate}} \sim \frac{70+50}{150} = 0.8.$$

Vaporisation is followed by re-condensation of the β layer; inter-diffusion between the re-condensed layer and the substrate also occurs. However in this case, one needs to consider the intermediate layer only, as the entire condensed layer does not take part in the diffusion. Moreover, within this intermediate layer only the fraction of β phase that has transformed to γ' is considered (β→γ' from loss of Al to substrate). This is approximately ~30% [FIG. 2(*a*)]. This corresponds to a ratio of $$\text{transformed condensed layer/substrate} = \frac{t_{Condensed}}{t_{Substrate}} \sim 0.3\left[\frac{50}{150}\right] = 0.1.$$

Figure 4:
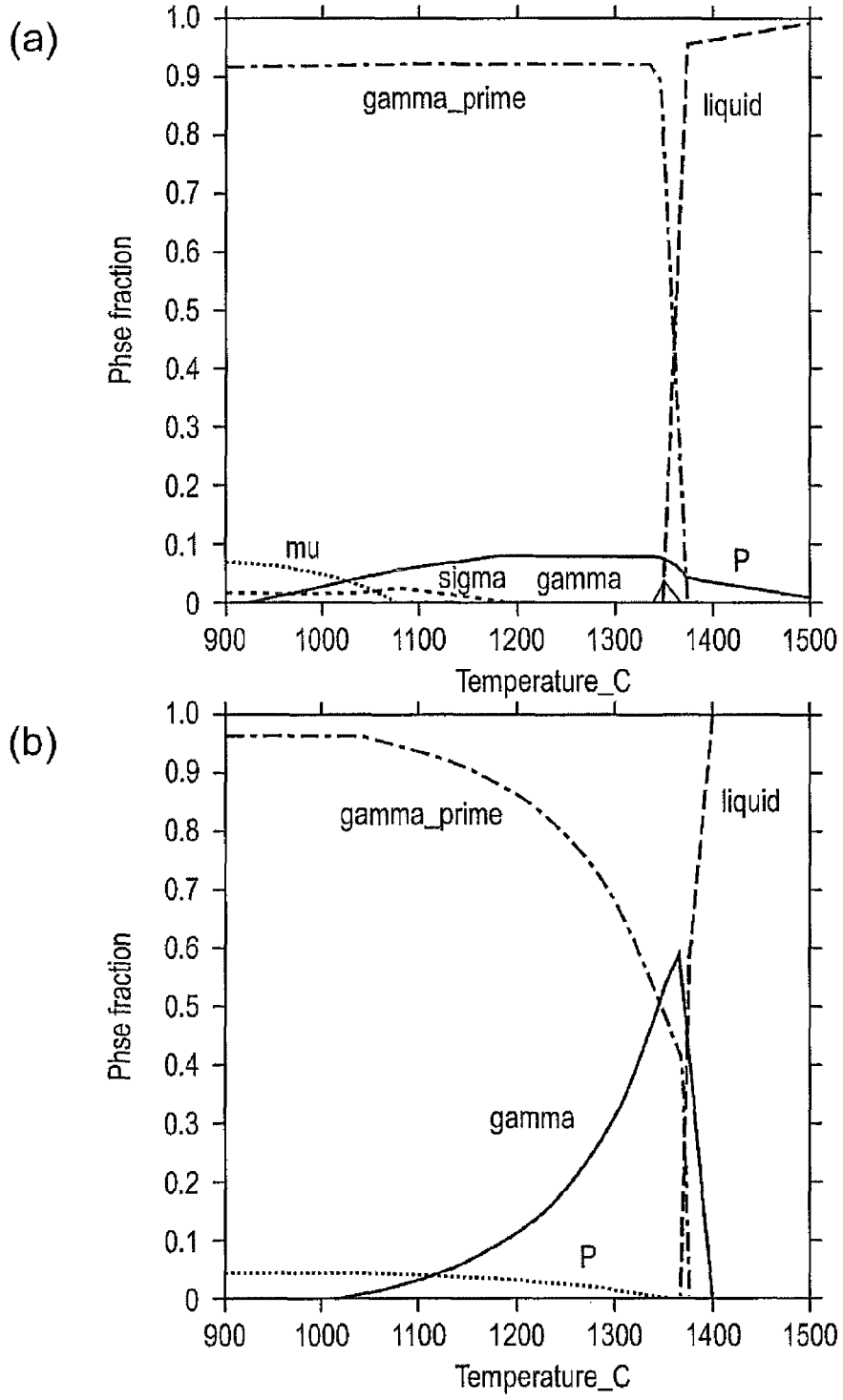
FIG. 4 shows phase fractions for two compositions determined using Thermocalc: (a) composition $C_2$ corresponding to the sample exposed to the furnace environment and (b) composition $C_3$ corresponding to the sample with dispersed sacrificial Ni foil in the furnace.

The composition within the substrate at the surface arising from inter-mixing following condensation gives the composition $C_2$. This is given by (wt. %); Al=6.9, Co=2.7, Cr=1.3, Mo=0.7, Ti=0.1 wt. %, Ta=11.8, W=7.7, Re=9.5, Ni=Bal. At the solutioning temperature of 1360° C., the phase distribution was calculated with the TTNI8 database using the Thermo-Calc software [9]. It is shown in FIG. 4(*a*) with the phase fractions being: liquid (6%), γ' (78%) and P-Phase (16%). There is very localised melting and in the presence of γ', TCP phases nucleate within the liquid to incorporate the excess Re and W. Consequently, following quenching after solutioning, γ' fraction remains constant and the TCP phase fraction also unchanged, see FIG. 4(*a*). It is clear that, unlike in [3], there is hardly any melting predicted and importantly, the precipitate morphology is distinctly different from the typical needle shaped TCP morphology, possibly due the lack of a significant energy barrier to nucleation [10].

Figure 5:
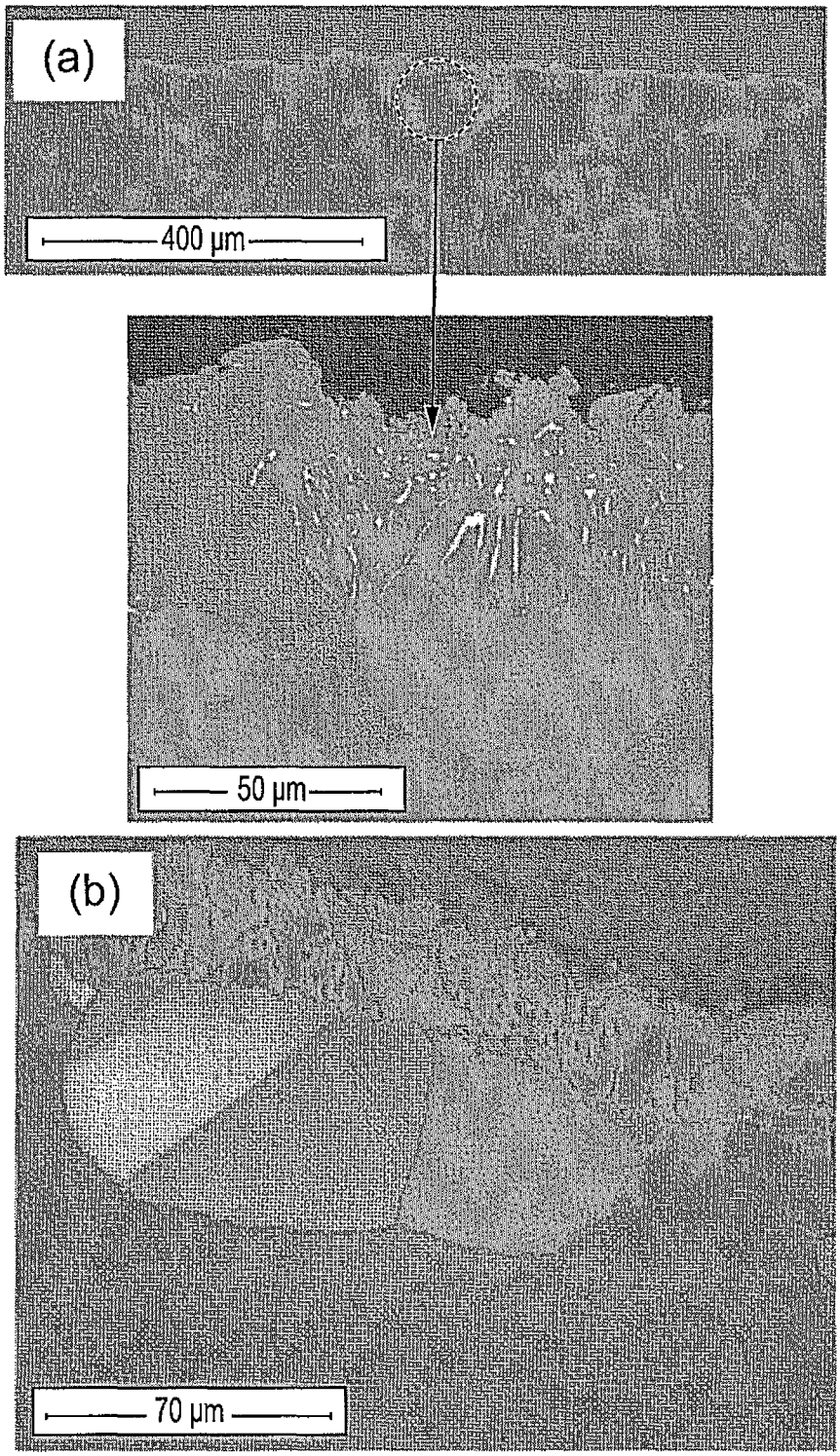
FIG. 5 shows BEI and EBSD images of cross-section of a sample exposed to the furnace environment with dispersed sacrificial Ni foil: (a) BEI image showing γ' and TCP phases; (b) EBSD image showing various orientations on the surface different from that of the substrate.

Further experimentation was carried out to provide further confirmatory evidence of the role of vaporisation and condensation from the surface. Use was made of Ni foils laid sacrificially within the furnace, close to the CMSX-10N material. Since the vapour pressure is fixed for a given temperature, vaporisation of Ni now occurs predominantly from the Ni foil rather than the specimen surface. Also, since Ni and Al no longer evaporate independently from the sample surface, the reduced Ni loss results in a decreased Al loss compared with the bar in the open boat. To repeat calculations like in the previous case, consider a low ratio of vaporised layer/substrate; typically 1:10, 1:20 and 1:30, which corresponds to a Ni loss of [5-15] mg (only half the bar is considered, since the cross-section in contact with the boat showed no such surface instability). The BEI image in FIG. 5(*a*) shows a marked difference in the microstructure compared with FIG. 2(*a*). The surface layer comprises of γ'+TCP phases that show the classical needle-type morphology; the surface layer is approximately [30-40] μm in thickness. The polycrystalline nature is confirmed in the IPF in FIG. 5(*b*). The stabilisation of the γ' phase requires enrichment in Al, which can only arise from condensation of β phase; however in this instance complete transformation of β→γ', has occurred unlike in the open boat case. For the elemental Ni (and therefore Al loss) loss of [5-15] mg it is still reasonable to consider the condensed layer/substrate ratio to be equivalent to that in the open boat case (~0.1), giving a composition ($C_3$) in (wt. %); Al=8.0, Co=3.1, Cr=1.5, Mo=0.46, Ti=Ta=7.8, W=5.1, Re=6.3, Ni=BaI. At the solutioning temperature of 1360° C., the calculated phase distribution was: γ (51%), β' (47.5%) and P-Phase (1.5%) and the absence of any liquid phase. As for the previous case, de-stabilisation of γ phase occurs. Therefore, at the solutioning temperature, growth of TCP phases is expected to occur with the characteristic needle-like morphology, since the nucleation and growth occurs from the parent γ phase [11]. Also, the γ phase is unstable below 1065° C. (FIG. 4*b*) and therefore as in the preceding case—during quenching following the isothermal hold—the excess Re grows on the existing P-phase that existed at the solutioning temperature without requiring any further nucleation.

Some other points with regard to the surface morphologies are interesting. There is the clear evidence of recrystallisation: the transformed substrate layer is polycrystalline. Grit blasting of the test bar surface to eliminate as-cast surface eutectic and oxide—consistent with industrial practice—results in mechanical strain imparted to the surface potentially leading to recrystallisation. During initial ramp-up, recrystallisation driven by mechanical strain occurs above ~1200° C., i.e. below the γ' solvus, resulting in a cellular precipitation morphology, i.e. γ+γ'+TCP phases. However, with increasing temperature, both the γ' and TCP phases dissolve and only the γ phase exists above the γ' solvus. Growth of the recrystallised grain then occurs into γ phase and the extent of growth is demarcated by the boundary remote from the surface in FIG. 5(*b*); some recrystallization twinning is also observed. The existence of surface stress during oxidation has been reported in [12]. Vaporisation is equivalent to oxidation in terms of elemental loss from the substrate followed by non-reciprocal diffusion of the other elements and it is not unexpected to observe a similar effect here. In fact, if non-reciprocal related recrystallisation was absent, one cannot account for the grain boundary in FIGS. 5(*b*) and (*c*) nearer the surface, which separates the large γ phase grain from the surface polycrystalline layer; indeed this latter boundary should not exist at all.

In conclusion, it has been confirmed that vaporisation and condensation play a crucial role in the evolution of surface microstructure during the heat treatment of these systems. Both phenomena occur, their relative extents determining the final microstructural state. Of significant practical significance is the observation that the amount of melting is limited and the strains arising within the substrate layers result in recrystallisation at the surface. By distinguishing between the processes of vaporisation, condensation and solute diffusion in the substrate, the phase evolution within the surface layers has been rationalised. The findings reported in this paper need to be taken into account when developing new alloys for aerospace applications, so that manufacturing capability is assured.

REFERENCES

[1] R. C, Reed, The Superalloys: Fundamentals and Applications, Cambridge University Press, Cambridge, 2006.

[2] N. D'Souza, S. Simmonds, G. D. West, H. B. Dong, Met. Trans. A, 2013, Vol. 44A, pp. 4764-4773.

[3] G. E. Fuchs, Mat. Sci. Eng. A, Vol. 300A, 2001, pp. 52-60.

[4] F. Cosentino, N. Warnken, J.-C. Gebelin and R. C. Reed, Met. Trans. A, 2013, Vol. 44A, pp. 5154-5164,

[5] C. D. Wagner, Handbook of x-ray photoelectron spectroscopy: Perkin-Elmer Corp., 1979.

[6] C. B. Alcock, V. P. Itken, M. K. Horrigan, Can, Met. Quart., Vol. 23, 1984, pp. 309-313.

[7] I. Langmuir, PhysikalischeZeitschrift, Vol 14, 1913, pp. 1273-1280.

[8] T. J. Nijdam, W. G. Sloof, ActaMater., Vol. 56, 2008, pp. 4972-4983.

[9] J.-O. Andersson, T. Helander, L. Hoglund, P. F. Shi, and B. Sundman, CALPHAD, Vol. 26, 2002, pp. 273-312. (TTNI8 database: http://www.thermocalc.com/)

[10] R. Darolia, D. F. Lahrman, R. D. Field, Superalloys 1988, Eds. S. Reichman et al, The Met. Soc., 1988, pp. 255-264.

[11] A. Heckl, S. Neumeier, S. Cenanovic, M. Goken, and R. F. Singer, ActaMater., vol. 59, 2011, pp, 6563-6573.

[12] Z. Suo, D. V. Kubair, A. G. Evans, D. R. Clarke, V. Tolpygo, Acta Met., Vol. 51, 2003, pp. 959-974.

The invention claimed is:

1. A method of producing a Ni superalloy component in which the superalloy has a γ phase matrix containing intermetallic γ' precipitates, the method including:

providing a Ni superalloy casting of the component, oxidising the component by heat treating the casting to produce a thermally grown oxide on a surface thereof, then solutioning the component by heat treating the casting under vacuum and/or in an atmosphere wherein the partial pressure of $O_2$ during the solutioning heat treatment is less than 0.21 atm at a temperature above the γ' solvus to homogenise the γ phase, and quenching and then ageing the solutioned component to grow intermetallic γ' precipitates in the homogenised γ phase;

wherein the oxide thermally grown on the surface of the casting is sufficiently adherent and stable to substantially supress volatilisation of Ni from the surface of the casting during the solutioning heat treatment.

2. A method according to claim 1, wherein the thermally grown oxide is $Al_2O_3$.

3. A method according to claim 1, wherein the oxidising heat treatment is performed at a temperature above 800° C.

4. A method according to claim 1, wherein the oxidising heat treatment is performed at a temperature below 1100° C.

5. A method according to claim 1, wherein the oxidising heat treatment is performed for at least 1 hour.

6. A method according to claim 1, wherein the thermally grown oxide has a thickness of at least 0.1 μm.

7. A method according to claim 1, wherein the thermally grown oxide is removed from the Ni superalloy component following the oxidising heat treatment.

8. A method according to claim 7, wherein further features are formed or machined into the Ni superalloy component following the removal of the thermally grown oxide.

9. A method according to claim 1, wherein the solutioning is performed under a Ni vapour pressure which is sufficient to substantially supress volatilisation of Ni from the surface of the casting during the solutioning heat treatment.

10. A method according to claim 1, wherein the component is a turbine blade.

11. A method of producing a Ni superalloy component in which the superalloy has a γ phase matrix containing intermetallic γ' precipitates, the method including:

providing a Ni superalloy casting of the component, solutioning the component by heat treating the casting under vacuum and/or in an atmosphere wherein the partial pressure of $O_2$ during the solutioning heat treatment is less than 0.21 atm at a temperature above the γ' solvus to homogenise the γ phase, and quenching and then ageing the solutioned component to grow intermetallic γ' precipitates in the homogenised γ phase;

wherein the solutioning is performed under a Ni vapour pressure which is sufficient to substantially supress volatilisation of Ni from a surface of the casting during the solutioning heat treatment.

12. A method according to claim 11, wherein, during the solutioning, the casting is heat treated at a temperature above the γ' solvus in the presence of sacrificial Ni to produce the Ni vapour pressure.

13. A method of producing a Ni superalloy component in which the superalloy has a γ phase matrix containing intermetallic γ' precipitates, the method including:

providing a Ni superalloy casting of the component, solutioning the component by heat treating the casting under vacuum and/or in an atmosphere wherein the partial pressure of $O_2$ during the solutioning heat treatment is less than 0.21 atm at a temperature above the γ' solvus to homogenise the γ phase, and quenching and then ageing the solutioned component to grow intermetallic γ' precipitates in the homogenised γ phase;

wherein during the solutioning heat treatment, the component is encapsulated in a container which protects the casting from Si-doped contaminants.

14. A method of producing a Ni superalloy component in which the superalloy has a γ phase matrix containing intermetallic γ' precipitates, the method including:

providing a Ni superalloy casting of the component, oxidising the component by heat treating the casting to produce a thermally grown oxide on a surface thereof, then solutioning the component by heat treating the casting under vacuum and/or in an inert atmosphere at a temperature above the γ' solvus to homogenise the γ phase, and quenching and then ageing the solutioned component to grow intermetallic γ' precipitates in the homogenised γ phase;

wherein the oxide thermally grown on the surface of the casting is sufficiently adherent and stable to substantially supress volatilisation of Ni from the surface of the casting during the solutioning heat treatment.

* * * * *